US011712401B1

(12) United States Patent
Yusuf

(10) Patent No.: US 11,712,401 B1
(45) Date of Patent: Aug. 1, 2023

(54) PILL BOTTLE CONTAINER INSERT

(71) Applicant: Osman Yusuf, Hollywood Park, TX (US)

(72) Inventor: Osman Yusuf, Hollywood Park, TX (US)

( * ) Notice: Subject to any disclaimer, the term of this patent is extended or adjusted under 35 U.S.C. 154(b) by 152 days.

(21) Appl. No.: 17/139,543

(22) Filed: Dec. 31, 2020

Related U.S. Application Data

(63) Continuation-in-part of application No. 17/077,299, filed on Oct. 22, 2020.

(51) Int. Cl.
*A61J 1/03* (2023.01)

(52) U.S. Cl.
CPC ..... *A61J 1/03* (2013.01)

(58) Field of Classification Search
CPC ..... A61J 1/03
USPC ..... 215/231; 206/528, 540, 814
See application file for complete search history.

(56) References Cited

U.S. PATENT DOCUMENTS 1,554,066 A * 9/1925 Boros ..... B65D 81/22 426/131
2,884,149 A * 4/1959 Zimmermann ..... B65D 51/26 215/320
3,169,654 A * 2/1965 Pollklesener ..... B65D 51/26 215/231
4,215,786 A * 8/1980 Vertes ..... B65D 51/26 215/231
4,279,351 A * 7/1981 Vertes ..... B65D 51/26 215/231
4,805,789 A * 2/1989 Lancesseur ..... A61J 1/03 220/504
5,316,146 A * 5/1994 Graff ..... A61B 10/0096 D24/227
6,398,051 B1 * 6/2002 Brozell ..... B65D 51/26 206/828

* cited by examiner

*Primary Examiner* — Jacob K Ackun
(74) *Attorney, Agent, or Firm* — Law Office of Sam Sokhansanj PLLC

(57) ABSTRACT

A lightweight pill container headspace occupying insert apparatus is disclosed that can be configured to conform to the general shape of an inner region of a pill container, such that the insert occupies or fills in the open or headspace the pill container thereby preventing movement of one or more pills or tablets within the container, among other advantages. The insert can include a biasing member having a first end and a second end, a first disc secured to the first end of the biasing member and a second disc secured to the second end of the distal member, wherein the first disc and second disc are configured to substantially align with an interior space of a pill container.

8 Claims, 11 Drawing Sheets

PILL BOTTLE CONTAINER INSERT

CROSS-REFERENCE TO RELATED APPLICATIONS

This application is a continuation-in-part (CIP) of U.S. Non-Provisional application Ser. No. 17/077,299 filed on Oct. 22, 2020, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Medicines and nutritional or dietary supplements can come in a multitude of formats, some of which include liquids, drops, tablets, capsules, inhalers, suppositories, patches, and topicals. Specifically referring to oral medication or supplements, one of the more common forms of oral medication is the tablet, which is also known as a pill. Another popular form of oral medication is the capsule. A tablet is traditionally manufactured by compressing the medicine, typically in the form of powder ingredients, into a single solid structure. A capsule is manufactured by enclosing the medicine into an outer shell or capsule. The outer shell or capsule would later dissolve once ingested to release the medication, just as the tablet itself would break down once ingested, both achieving the same end.

The packaging and storage of tablets and capsules come in two main varieties, the pill bottle container and blister pack. A pill bottle container is typically of plastic construction but can also be of a glass construction. Beginning from the uppermost in an upright position, a pill bottle contains a closure or cap, then an orifice, also commonly known as the throat or bore, then a neck, a shoulder, a body, and finally a base. While still upright, the bottle orifice is pointed upwards and located at the uppermost of the bottle, and this section of the bottle is where the contents, in this case the pills, would be inserted and removed for consumption. The neck then extends down to the shoulder which is sloped to adjoin the constricted neck to the larger diameter body, which is the section of the bottle in which the product comes to rest upon the base inside the container when still in the upright position by force of gravity. Some other common varieties of pill bottle containers are more completely cylindrical in shape with a constant diameter throughout, with an orifice and body of the same diameter down to the base, and can be described as absent of a neck and shoulder. Irrespective of type, all pill bottles contain a cap, orifice, body and base.

Referring to the differences between a pill bottle container and blister pack, the pill bottle container is used for loose tablets or capsules, while the blister pack is not. A blister pack is typically a plastic sheet formed with multiple individual raised cavities (blisters), which house the tablet or capsule, and a sealed aluminum foil backing. Typically, an individual tablet or capsule will fill each cavity, although there may be multiple tablets or capsules found in a single cavity for dosage requirements. The main difference from the pill bottle container being that the blister pack allows the medication to be secure and sealed from one another and the elements at large, as opposed to the pill bottle container where the tablets or capsules are not sealed and secured from one another but rather combined together jointly yet loosely in the same pill bottle container. Hence the tablets or capsules would occupy the bottommost area of the sealed pill bottle container irrespective of the pill bottle container position, due to gravity, and any unfilled space above the contents is commonly referred to as "headspace".

Due to the sensitive, potentially harmful and highly regulated nature of medication, packaging standards are typically higher versus that of other everyday innocuous or regular items, which include, among others, child proofing the pill bottle container by means of child resistant caps on the pill bottles and the like. Some other designs include senior friendly packaging, so as to allow persons of age that may have weaker than normal mechanical abilities to access their medication despite the usual robust packaging. Some of these packaging nuances favor the pill bottle container while others favor the blister pack.

Specifically referring to the pill bottle as a tablet or capsule container, one of the major drawbacks include the irritating noise of the tablets or capsules striking against one another in the pill bottle while in transit, for example while in a handbag, suitcase or pocket. In addition, another downside to the act of tablets or capsules striking against or continuously striking each other would be the early and rapid degradation or breakage of the tablet or capsule itself, which could negatively affect the quality and dosage of medication and therefore have potentially drastic health consequences for the consumer. This is due to headspace being nearly ever-present in every pill bottle container, even ones newly purchased from the store or newly filled in the pharmacy. Medication manufacturers and pharmacists typically use standard sized bottles which must be large enough for the product information labeling requirements, coupled with the medication product itself needing to be smaller and smaller in size due to the nature of oral administration or human ingestion and its inherent size limitation requirements. Also, in the unlikely event that a pill bottle container is in fact originally packaged and occupied to the exact brim or to the top to entirely void of any headspace, a headspace will eventually form and grow larger as the medication is consumed. Thus, headspace is inevitable in this exercise.

Historically, and in some cases dating as far back as the early 1900s, medication manufacturers have solved the pill bottle container rattling issue by means of stuffing cotton balls or a large wad of cotton into the pill bottle in order to occupy the headspace. The user would open the pill bottle, reach into the orifice with a few fingers and then pull and remove the cotton balls or wad to access and take their medication, and re-insert the cotton before finally closing and sealing the pill bottle for storage. It is understood the main reason manufactures employed the use of cotton balls or wad to prevent the tablets or capsules from rattling against or striking against one another was mainly to prevent tablet breakage, as the ingredients and methods of manufacturing tablets were inferior in the early 1900s, often being very powdery, weak and therefore fragile. Today, superior technology and techniques have evolved, and tablets are much stronger with special coatings to prevent such breakage, and capsules are stronger also being manufactured of more durable outer shells and processes. As a result, today, very few if any, medication manufacturers still employ the use of cotton balls or wad, and the practice has almost completely ceased from existence for the aforementioned reasons of advances in manufacturing technology, processes and techniques. Furthermore, it is now better understood the effect of such cotton in medication packaging, and experts believe the practice to be destructive as the cotton has the potential to attract moisture and therefore cause early degradation of the medication product. Also problematic is the cotton ball or wad itself, which due to its construction and characteristics is not of a solid structure and rather fibrous and easily pulled apart, which makes the task of removing it from a pill bottle difficult and also has the harmful potential of itself being ingested by accident along with the medication. Also, as the medication product is consumed a headspace would eventually form or at least grow larger, which the cotton may not occupy as cotton may not expand sufficiently, therefore rendering the use ineffective and obsolete. Accordingly, today most medication manufacturers and pharmacies alike employ pill bottle packaging without any means of rattle prevention and moisture control.

Hence, what is needed is a pill bottle container insert that occupies the headspace region of the container, expands and shrinks as needed to restrict the movement of the contained product, therefore eliminating any audible rattling noise from the pills and preventing degradation or breakage of the pills while maintaining product quality.

BRIEF SUMMARY

In one aspect of the present disclosure described herein, a lightweight, pliable, elastic, and bounded pill container headspace occupying insert apparatus is disclosed that is in the general shape of the inner area of a pill bottle container body, such as a cylindrical configuration, in which it is intended to be used, to assist with occupying the headspace of a pill bottle container. In particular, a headspace occupying apparatus can include an integral ring pull, lanyard or knob located on one side which is accessible through a pill bottle orifice. Here, an integrated ring pull, lanyard or knob may be used to remove the insert apparatus from the pill bottle to allow access to the pills beneath. In particular, the pill bottle container insert occupies the headspace region of the container, expands and shrinks (or reduces in size) as needed to restrict the movement of the contained product, therefore eliminating any audible rattling noise from the pills and preventing degradation or breakage of the pills while maintaining product quality.

In another aspect of the disclosure described herein, a headspace occupying insert apparatus is disclosed being integrated or secured to a pill bottle closure or cap. In another aspect of the disclosure described herein, a pill container headspace occupying insert apparatus is disclosed containing a lip or ledge on one end with substantially same diameter and shape of a pill bottle rim in which it is intended to be used, which therefore allows it to be secured to and rest upon a pill bottle rim, and further allows a pill bottle closure or cap to be fully engaged, closed and sealed as normal. Here, a ring pull, lanyard or knob may be included.

In another aspect of the disclosure described herein, a pill container headspace occupying insert apparatus is disclosed having a plunger or sealing mechanism on one side, which coincides or abuts against the inner diameter of the pill bottle body in which it is to be used, therefore creating a seal with the inner wall. Here, the plunger can also maintain an appropriate diametric gap with the inner pill body wall to ensure ease of insertion and air passage, to avoid a vacuum. Here, the gap need not be larger than the product being contained. In addition, the plunger may contain a hole, perforations or mesh to allow the passage of air to avoid a vacuum. In addition, a spring is connected to and secured above the plunger and will maintain downward pressure on the plunger when the pill bottle closure or cap is fully engaged, closed and sealed.

In another aspect of the disclosure described herein, a pill container headspace occupying insert apparatus is disclosed being of the necessary size coinciding with the inner volumetric area of a pill bottle body in which it is intended to be used. In addition, the insert apparatus is constructed of a material which is pliable and elastic, such as cellular foam, therefore easily compressible to a smaller mass in order to assist with insertion into and removal from a pill bottle orifice or throat which later expands back to its original shape therefore occupying the total headspace a pill bottle body.

In another aspect of the disclosure described herein, a pill container headspace occupying insert apparatus is disclosed constructed of a moisture-resistant, antimicrobial and/or an antibacterial material to maintain product quality of the contents in which is being secured in the pill bottle. In addition, a sensor and transmitter which monitors, detects and transmits product quality and quantity data may be included in the apparatus. Also, a visual moisture or quality indicator may be included in the apparatus.

In another aspect of the disclosure described herein, a pill container insert is disclosed, wherein the insert includes compressible and expandable properties, the insert includes a cylindrical configuration with a first and second end, and a tab secured to the first end. In addition, the insert can be comprised of one or more of: foam material, polyethylene foam, closed cell foam, rubber, or any polymer-based material. Further, the tab can include one or more of: a ring, knob, latch, hook, lanyard, string, line, or rope. In addition, the diameter of the insert can be larger than the diameter of a pill container that it is to be inserted in. Alternatively, the diameter of the insert can be substantially the same or less than the diameter of a pill container. Further, the height of the insert can be higher or lesser than the height of a pill container.

In another aspect of the disclosure described herein, a pill container insert is disclosed, wherein the insert includes compressible and expandable properties, the insert includes a round or cylindrical configuration with a first and second end; and the first end of the insert secured to a pill bottle cap. In addition, the insert can be comprised of one or more of: foam material, polyethylene foam, closed cell foam, rubber, or any polymer-based material. Further, the diameter of the insert is larger than the diameter of a pill container. Alternatively, the diameter of the insert can be substantially the same or less than the diameter of a pill container. Further, the height of the insert is higher or lesser than the height of a pill container.

In another aspect of the disclosure described herein, a method of inserting a pill container insert is disclosed. The method includes compressing the insert comprised of compressible and expandable properties into a smaller shape or configuration relative to its un-compressed shape or configuration, and inserting the compressed insert into a pill container such that one end of the insert abuts against a plurality of pills or tablets within the container, thereby the insert substantially occupying an open region or headspace of the container. The method can further include removing the insert from the pill container via a tab on an opposing end of the insert. Alternatively, the method can include removing the insert via removing a cap of the pill container, wherein the insert is secured to the cap.

In another aspect of the disclosure described herein, a pill container insert is disclosed that includes a biasing member having a first end and a second end. In addition, a first disc can be secured to the first end of the biasing member and a second disc secured to the second end of the distal member, wherein the first disc and second disc are configured to substantially align with an interior space of a pill container. In addition, the first and second discs can include one or more of foam material, polyethylene foam, closed cell foam, rubber, and any polymer-based material. Further, a diameter of the second disc can be larger than a diameter of the first disc. In addition, a diameter of the first and second discs can be greater than an inner diameter of a pill container. Alternatively, a diameter of the first and second discs can be less than an inner diameter of a pill container. Alternatively, a diameter of the first or second discs can be substantially the same as an inner diameter of a pill container. In addition, a height of the insert can be higher than a height of a pill container. Further, the first or second discs, or both, can also include one or more holes, apertures, or openings. In addition, the biasing member can be a compression spring. The pill container insert may also include a telescoping cylinder member disposed within the compression spring. Further, the compression spring can be disposed within a telescoping cylinder member.

In another aspect of the disclosure described herein, a method of inserting a pill container insert is disclosed. The method can include inserting an insert having a biasing member in a first un-compressed configuration into a pill container wherein a first end of the insert abuts against a plurality of pills or tablets within the container, placing a closure for the pill container on a second end of the insert and securing the closure to the pill container such that the biasing member is in a second compressed configuration thereby substantially occupying an open region or headspace of the container.

The above summary is not intended to describe each and every disclosed embodiment or every implementation of the disclosure. The Description that follows more particularly exemplifies the various illustrative embodiments.

DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
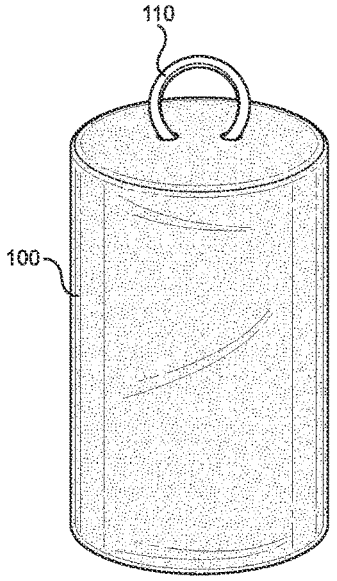
FIG. 1 illustrates a perspective view for one non-limiting exemplary embodiment of the pill container headspace occupying insert apparatus of the disclosure described herein having an integrated pull ring.

FIG. 1 illustrates a perspective view for one non-limiting embodiment of the headspace occupying insert apparatus 100 of the disclosure described herein. Here, insert 100 is shown having a general cylindrical shape configuration that allows it to be used in a cylindrical shaped pill bottle container. However, it is contemplated within the scope of the present disclosure described herein that insert 100 may include any other shape, such as spherical, oval, ellipsoid, square, rectangular, asymmetrical, or any shape that substantially conforms or aligns with the interior volumetric space of a pill container. In addition, insert 100 may be of any material that allow it to be compressed from its original by any factor, such as from a ratio ranging from about 2:1 to 10:1, and then expand to any other ratio or back to its original form. For example, insert 100 may be comprised of soft or dense foam, polyethylene foam, closed cell foam, rubber, or any polymer-based type of material. Alternatively, the material of insert 100 may not need to be necessarily compressible and expandable, but include flexible, elastic, or resilient properties.

Still referring to FIG. 1, insert 100 may also include a ring pull or tab 110 that allows a user to remove insert 100 from the pill container. Specifically, ring pull or tab 110 may be of any material, such as metal, where it is partially (or substantially) embedded, or penetrated, within the interior body of insert 100. Alternatively, insert 100 may have an opening or aperture at one of its ends that allows ring 110 to be inserted therethrough and removed if needed. Further, the body (or a certain region) of insert 100 may be reinforced with suitable material or the exterior of the body reinforced with a coating that can prevent tab 110 to be pulled apart from insert 100. In addition, it is further contemplated within the scope of the present disclosure described herein that any other type of pull device or mechanism may be used in lieu of tab 110. For example, a lanyard, string, rope, knob, latch, hook, line, or any other type of pull device or mechanism that allows insert 100 to be pulled from the top may be used in lieu of or (or in combination with) tab 110.

Figure 2:
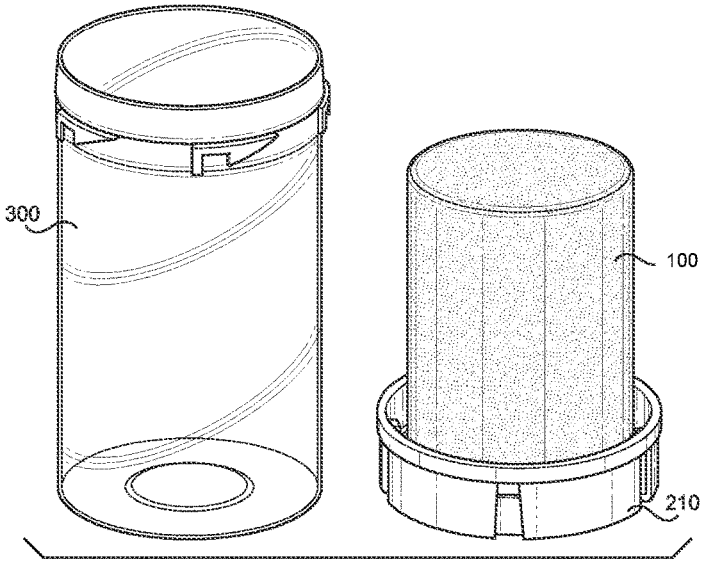
FIG. 2 illustrates a perspective view of another non-limiting exemplary embodiment of the pill container headspace occupying insert apparatus of the disclosure described herein shown secured to a pill container cap and removed from the pill container.
Figure 3:
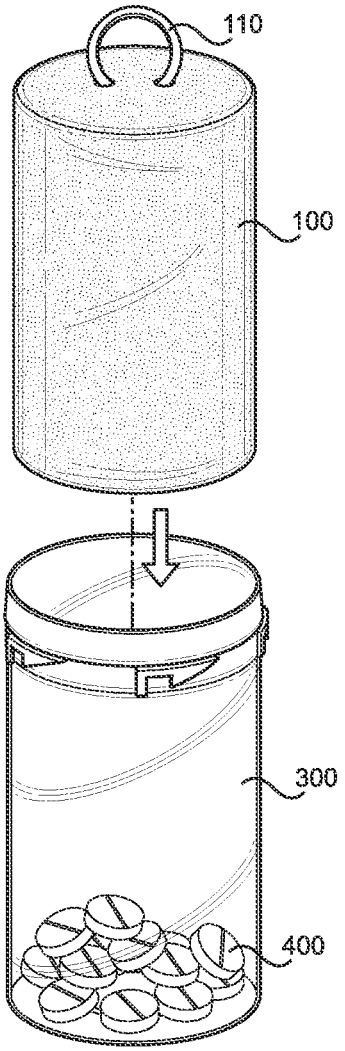
FIGS. 3-6 illustrate perspective views of one non-limiting exemplary embodiment of a method of inserting the insert apparatus of the disclosure described herein into the pill container.
Figure 4:
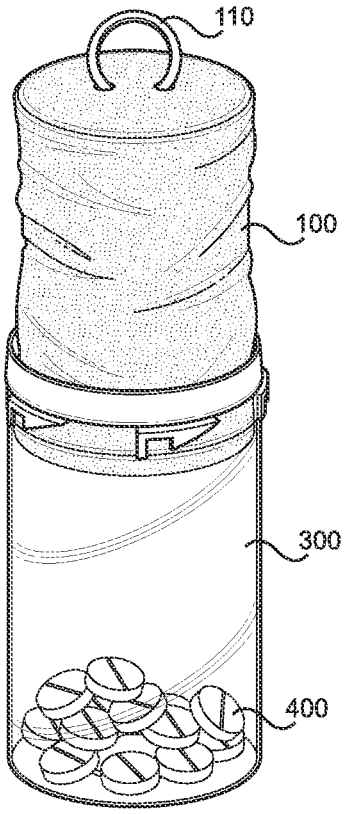

FIG. 2 illustrates a perspective view of one non-limiting embodiment of insert 100 of the disclosure described herein shown including a pill bottle 300 and integral cap 210. Here, insert 100 is shown having a general cylindrical shape configuration while attached or affixed to the below region of a pill bottle cap 210, that substantially conforms to the cylindrical shaped pill bottle 300. Specifically, in this embodiment, one end of insert 100 is secured or affixed to the region underneath pill ap 210, such as via an adhesive or any other attachment mechanism, in lieu of insert 100 including a pulling device, such as tab 110.

Figure 5:
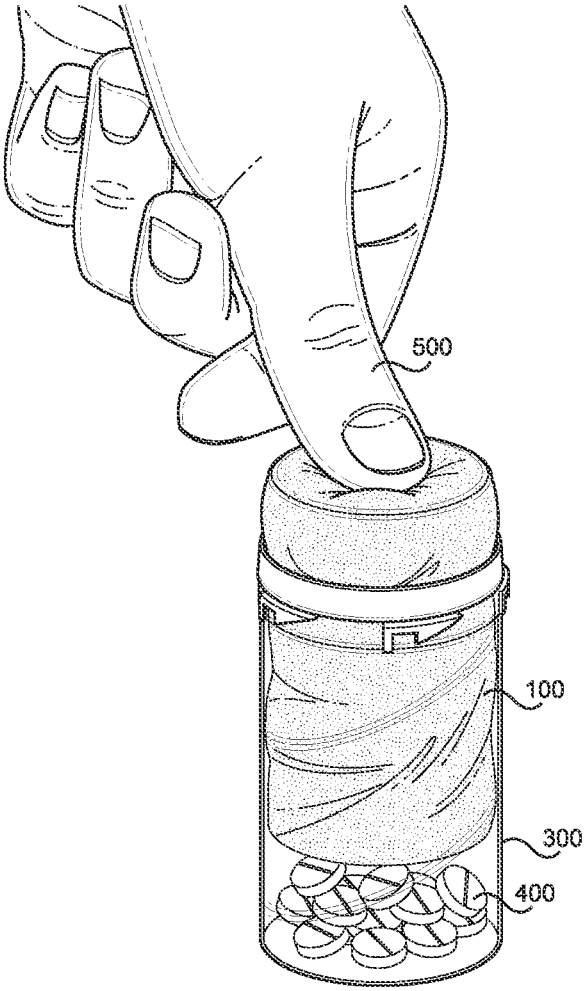
Figure 6:
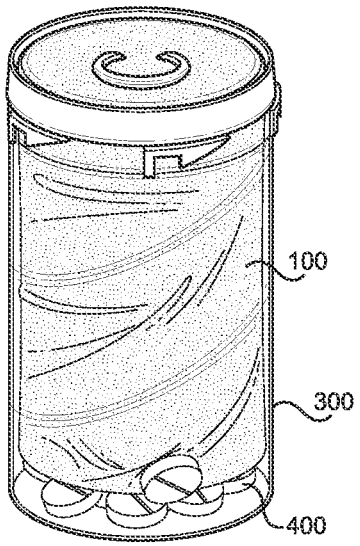
Figure 7:
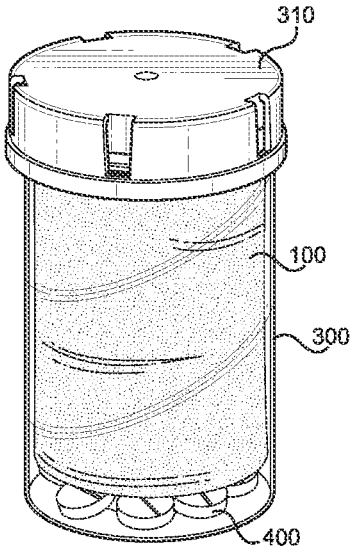
FIG. 7 illustrates a perspective view of one non-limiting exemplary embodiment of the insert apparatus of the disclosure described herein shown fully inserted into the sealed pill container.
Figure 8:
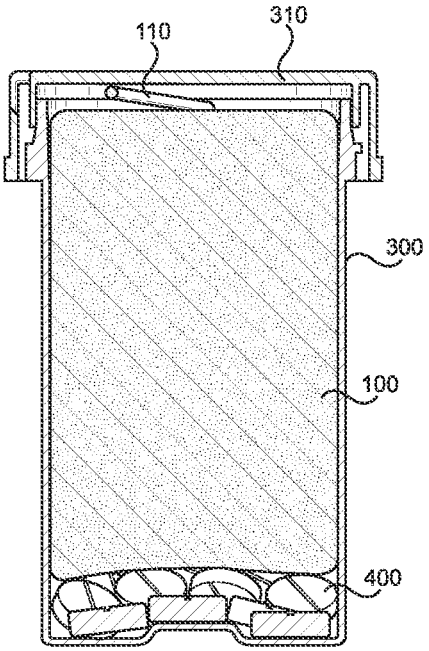
FIG. 8 illustrates a partial cross-sectional view of the sealed pill container containing the insert apparatus of the disclosure described herein shown fully inserted into the sealed pill container of FIG. 7.

FIGS. 3-6 illustrates perspective views of one non-limiting embodiment of a method of inserting insert 100 of the disclosure described herein in pill bottle container 300 having a plurality of bills or tablets 400 therein. In particular, an arrow depicts the insertion direction of insert 100 100 into the headspace or interior region of pill bottle container 300. Here, in one embodiment, prior to insertion, insert 100 may be compressed by the user's hand to a smaller size or smaller diameter, similar to the compression of foam ear plugs prior to insertion into the ear. Alternatively, insert 100 may be compressed on its own as its being slid into the interior region of the pill container by the interior walls of the container. Specifically, insert 100 may have a slightly larger diameter (or width) than the diameter (or width) of the pill bottle container to allow for a tight seal after expansion of insert 100 within the pill bottle. In addition, insert 100 may also have a slightly larger height than the height of the bill bottle container. Alternatively, insert 100 may have substantially the same diameter or lesser diameter relative to the diameter of the pill bottle container and/or or the same height or lesser height relative to the pill bottle container, with the goal of providing a compressive force against the pills or tablets 400 within the pill container. As shown in FIGS. 5-6, the user may further assist insertion of insert 100 into pill container 300. After full insertion, or partial insertion, of insert 100, the user may close the pill container with its provided cap and secure or lock the cap onto the opening of the pill container, as shown in FIGS. 7-8. As shown in FIG. 8, tab 110 can pivot and rest on top of insert 100 to allow the user to close the cap. Here, the compressive force provided by insert 100 against pills 400 prevent the pills from moving within the pill container, as also shown in FIG. 8. It is contemplated within the scope of the present disclosure described herein that the compressive force of insert 100 is such that it prevents movement or rattling of the pills within the pill container, but the compressive force of insert 100 is defined such that it would not damage or break the pills within the pill container, either during the insertion process, while inserted, or the removal process. In addition, it is contemplated within the scope of the present disclosure described herein, that insert 100 may be made of any material having compression and expandability properties that is best suited for the type of pills or tablets or pill container for which it would be used for. For example, softer or more brittle pills, may require the insert 100 to be of softer material with (with less compressive and expandability force), whereas harder or more dense pills may require insert 100 to be of a material having more compression and expandability force.

Figure 9:
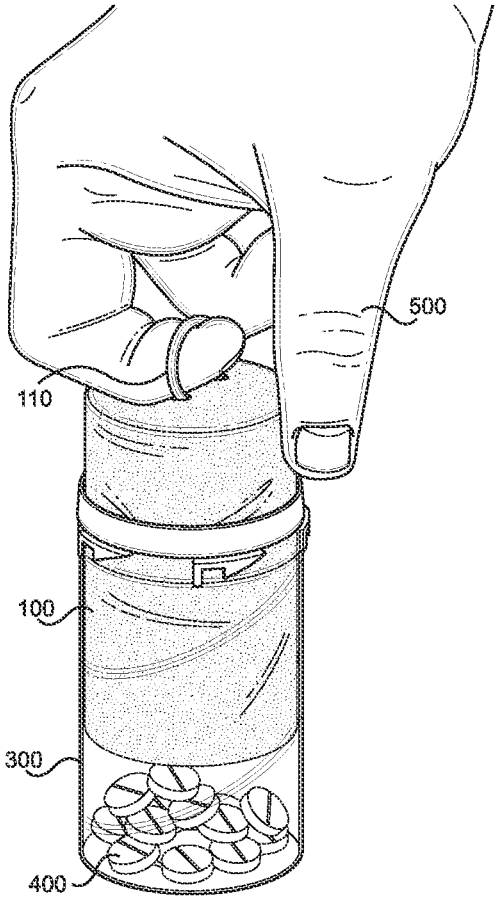
FIGS. 9-10 illustrate perspective views of one non-limiting exemplary embodiment of a method of removing the insert apparatus of the disclosure described herein from the pill container.
Figure 10:
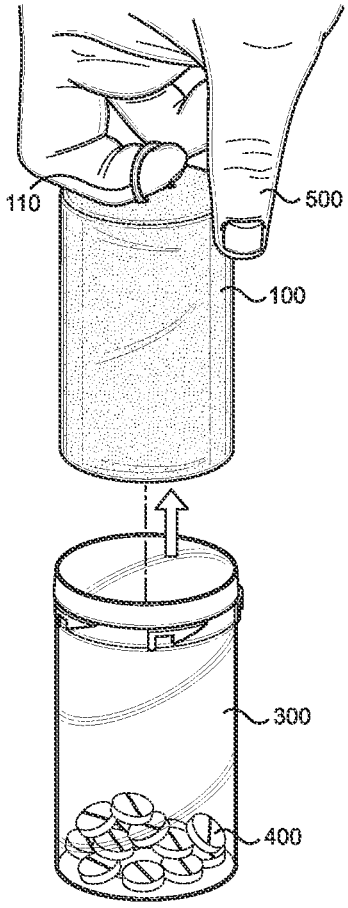

FIGS. 9-10 illustrate perspective view of one non-limiting embodiment of removing insert 100 of the disclosure described herein from pill bottle 300. Here, a hand and finger 500 of a user has engaged the ring pull or tab 110, pulling and removing apparatus 100 from pill bottle container 300 with pills 400. Alternatively, with respect to the embodiment of FIG. 2, if the user were to remove cap 210, then insert 100 would also be removed from the pill container.

Figure 11:
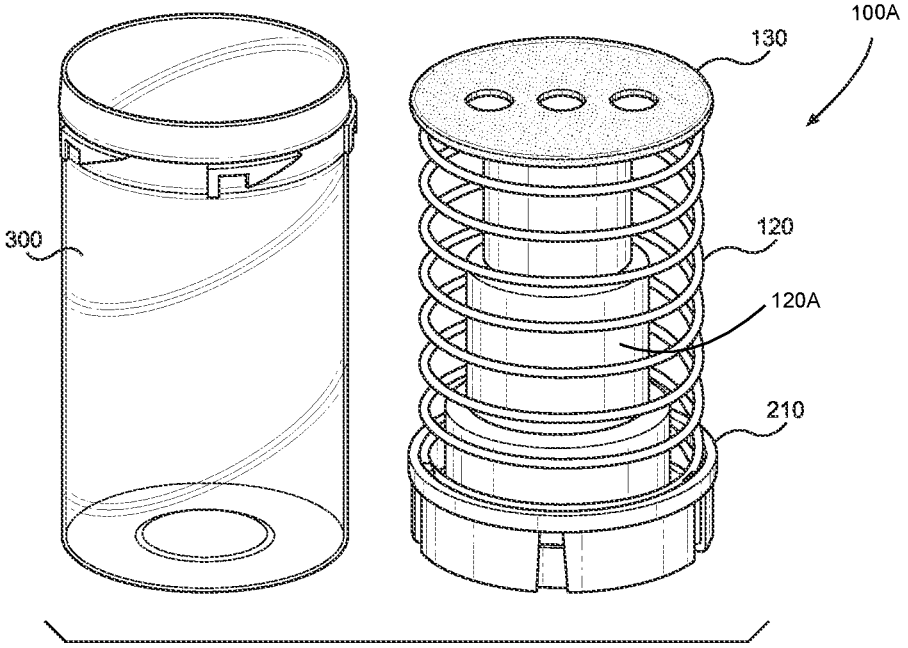
FIG. 11 illustrates a perspective view of another non-limiting exemplary embodiment of the insert apparatus of the disclosure described herein shown with a compression spring having a telescoping piston or multi-stage cylinder member therein and seal mechanism secured to the pill container cap and removed from the pill container.

FIG. 11 illustrates another non-limiting exemplary embodiment of insert 100 of the disclosure described herein. Specifically, in this embodiment, pill container headspace occupying insert apparatus 100 is disclosed having a plunger or seal 130 on one end, wherein the perimeter of seal 130 aligns and abuts against the inner diameter walls of the pill container body 300 in which it is to be inserted therein, therefore creating a seal with the inner wall of the pill container 300. Here, seal 130 can be made of any material, including but not limited to foam material, polyethylene foam, closed cell foam, plastic, metal, wood, rubber, or any polymer-based or fiber-based material. In addition, seal 130 may be round, circular, ellipsoid, square, rectangular, cylindrical, asymmetrical, or have any disc-shaped in configuration of any thickness. For example, seal 130 may be configured to take the shape of an ellipsoid configuration which can align with an ellipsoid shaped interior of a pill container. Here, the plunger or sealing 130 can be biased via a compression spring 120 and secured to the distal end of spring 120 and the proximal end of spring 120 secured to the bottle cap 210. It is contemplated within the scope of the present disclosure described that any other biasing member may also be used in lieu of or in addition to spring 120, such as a helical-based biasing member. Here, spring 120 can further include a telescoping piston or multi-stage cylinder member 120A disposed within spring 120, such as three ringed cylinders of varying sizes configured to collapse into each other or expand away from each other in concert with the movement of spring 120. Piston member 120A can generally assist spring 120 to move in a uniform up and down pattern without unnecessarily swaying to one side when inserted within the pill container, in addition to preventing overextension of spring 120. In particular, one end of piston member 120A can be secured to the seal 132A and the other end to seal 132B. Further, it is contemplated within the scope of the disclosure described herein that piston member 120A can have any number of telescoping cylinders, such as two or three or more.

Still referring to FIG. 11, spring 120 is configured to provide downward force or pressure on the pills or tablets being contained within pill container 300 once insert 100A and seal, plunger, or disc 130 thereof of are inserted into pill container 300 (with cap 210 secured to the open end of container 300). Here, seal 130 can also maintain an appropriate diametric gap with the inner pill body wall to ensure ease of insertion and air passage to avoid a vacuum. Specifically, the diameter of seal 130 may be slightly less than the diameter of the interior wall of pill container 300. However, the gap between seal 130 and inner walls of container 300 need not be larger than the product or pills being contained. In addition, the plunger or seal 130 may contain one or more holes, apertures, or perforations, or a mesh screen to allow the passage of air therethrough to avoid a vacuum.

Figure 12A:
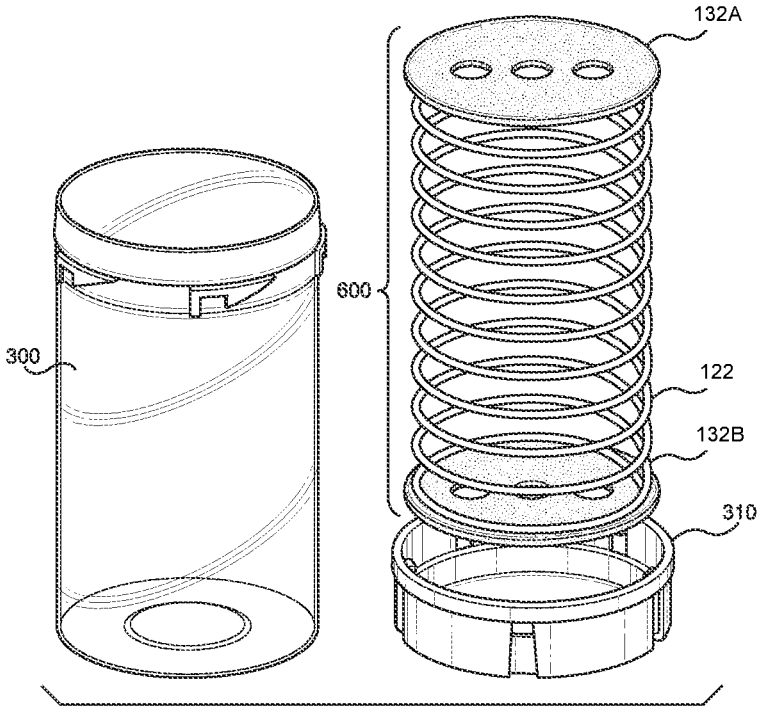
FIG. 12A illustrates a perspective view of another non-limiting exemplary embodiment of the insert apparatus of the disclosure described herein shown with a compression spring having seals on both ends that are independent of the container cap, wherein the insert apparatus is shown removed from the pill container.
Figure 12B:
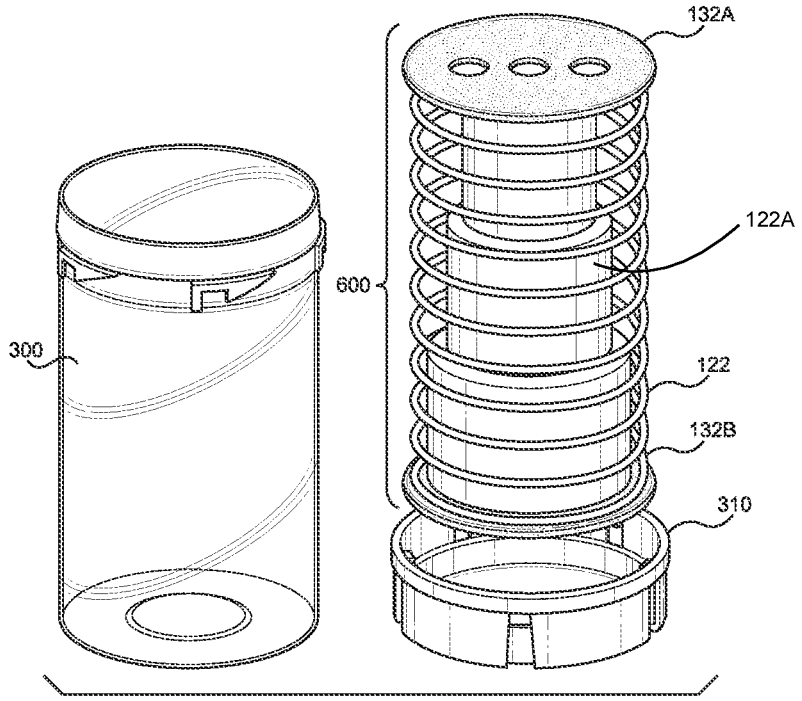
FIG. 12B illustrates a perspective view of the insert apparatus of the of FIG. 12A further shown with a telescoping piston or multi-stage cylinder member disposed within the compression spring and further showing the seals on both ends that are independent of the container cap, wherein the insert apparatus is shown removed from the pill container.

FIGS. 12A-12B illustrate another non-limiting exemplary embodiment of insert 600 of the disclosure described herein. Specifically, in this embodiment, pill container headspace occupying insert apparatus 600 is disclosed having a plunger, end cap, seal, or discs 132A on one end and another plunger, end cap, seal, or disc 132B at another end, wherein the perimeter of discs 132A and 132B align and abut against the inner diameter walls of the pill container body 300 in which it is to be inserted therein, therefore creating a seal with the inner wall of the pill container 300. Here, discs 132A and 132B can be made of any material, including but not limited to foam material, polyethylene foam, closed cell foam, plastic, metal, wood, rubber, or any polymer-based or fiber-based material. In addition, discs 132A and 132B may be round, circular, ellipsoid, square, rectangular, cylindrical, asymmetrical, or have any disc-shaped in configuration of any thickness. Here, discs 132A or 132B can be biased via a compression spring 122 and each secured to the distal ends of spring 122. It is contemplated within the scope of the present disclosure described that any other biasing member may also be used in lieu of or in addition to spring 122, such as a helical-based biasing member. Here, spring 122 can further include a telescoping piston or multi-stage cylinder member 122A disposed within spring 122, such as three ringed cylinders of varying sizes configured to collapse into each other or expand away from each other in concert with the movement of spring 122. Piston member 122A can generally assist spring 122 to move in a uniform up and down compression pattern without unnecessarily swaying to one side when inserted within the pill container, in addition to preventing overextension of spring 122. In particular, one end of piston member 122A can be secured to the seal 132A and the other end to seal 132B. Further, it is contemplated within the scope of the disclosure described herein that piston member 122A can have any number of telescoping cylinders, such as two or three or more.

Still referring to FIGS. 12A-12B, spring 122 is configured to provide downward force or pressure on the pills or tablets (and upward pressure on the inner region of cap 310) being contained within pill container 300 once insert 600 and discs 132A and 132B thereof of are inserted into pill container 300 (with cap 310 secured to the open end of container 300). Once insert 600 is inserted, spring 122 can be compressed to any degree depending on the volume or amount of pills within container 300. Here, discs 132A and 132B can also maintain an appropriate diametric gap with the inner pill body wall to ensure ease of insertion and air passage to avoid a vacuum. Specifically, the diameter of discs 132A and 132B may be slightly less than the diameter of the interior wall of pill container 300. However, the gap between discs 132A and 132B and inner walls of container 300 need not be larger than the product or pills being contained. In addition, discs 132A and 132B may contain one or more holes, apertures, or perforations, or a mesh screen to allow the passage of air therethrough to avoid a vacuum.

Figure 13:
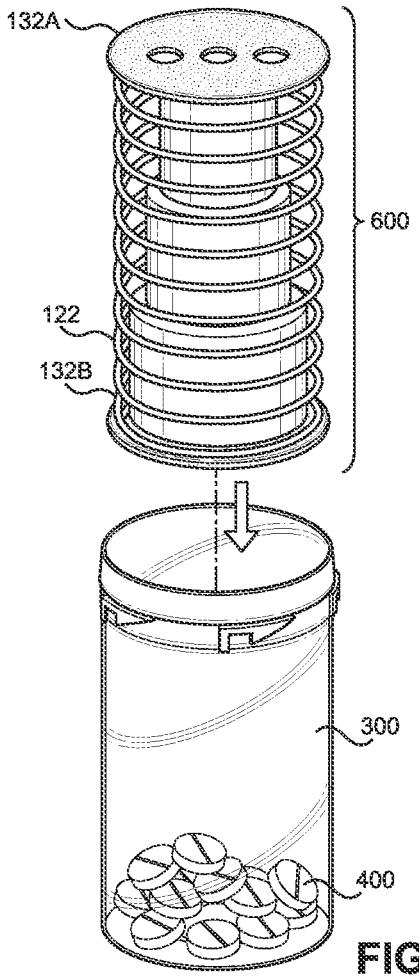
FIGS. 13-14 illustrate perspective views of the insert apparatus of FIGS. 12A-12B shown in a method of inserting the insert apparatus into the pill container.
Figure 14:
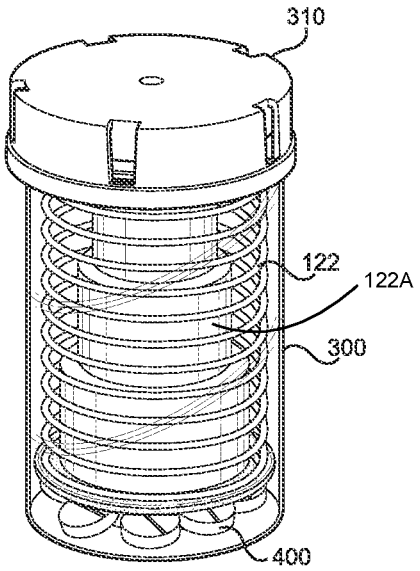

FIGS. 13-14 illustrate one method of inserting insert 600 for the embodiment of FIGS. 12A-12B into the standard prescription pill container 300. In particular, while spring 122 is an un-compressed state or configuration, insert 600 is inserted inside of pill container 300, wherein disc 132B makes contact with and abuts against pills 400 therein. Next, closure cap 310 of the pill container can then be placed on top of disc 132A such that it abuts against it. Next, cap 310 can then be secured or locked on to the top of the pill container such that the cap exerts a downward force on top of disc 132A and spring 122, such that spring 122 is compressed into a compressed state or configuration, whereby disc 132B exerts a downward pressure on pills 400, keeping the pills secure within the pill container.

Figure 15A:
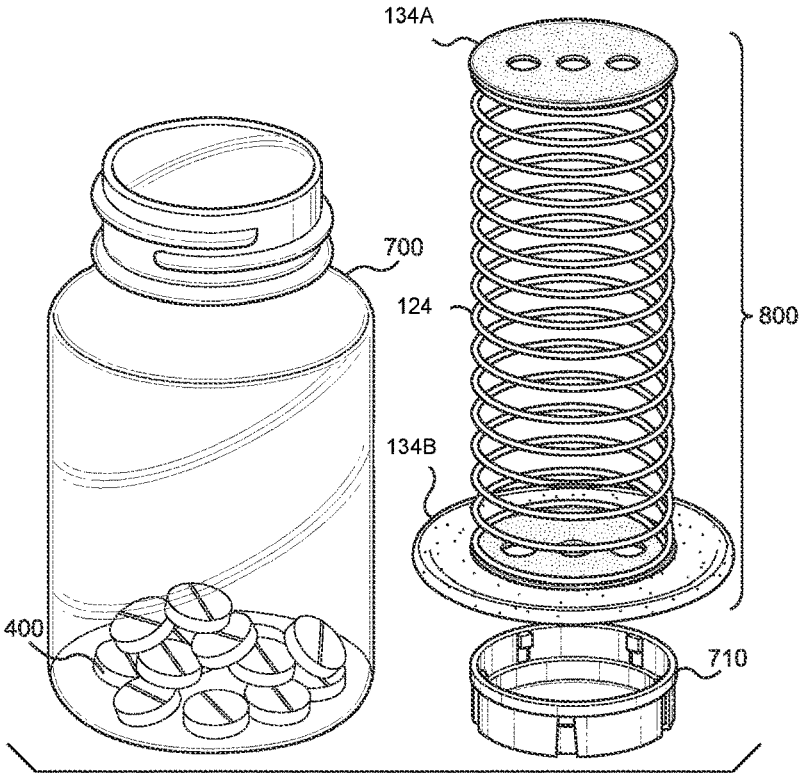
FIG. 15A illustrates a perspective view of another non-limiting exemplary embodiment of the insert apparatus of the disclosure described herein shown with a compression spring having seals of varying sizes secured to both ends of the spring that are independent of the container cap, wherein the insert apparatus is shown removed the pill container.
Figure 15B:
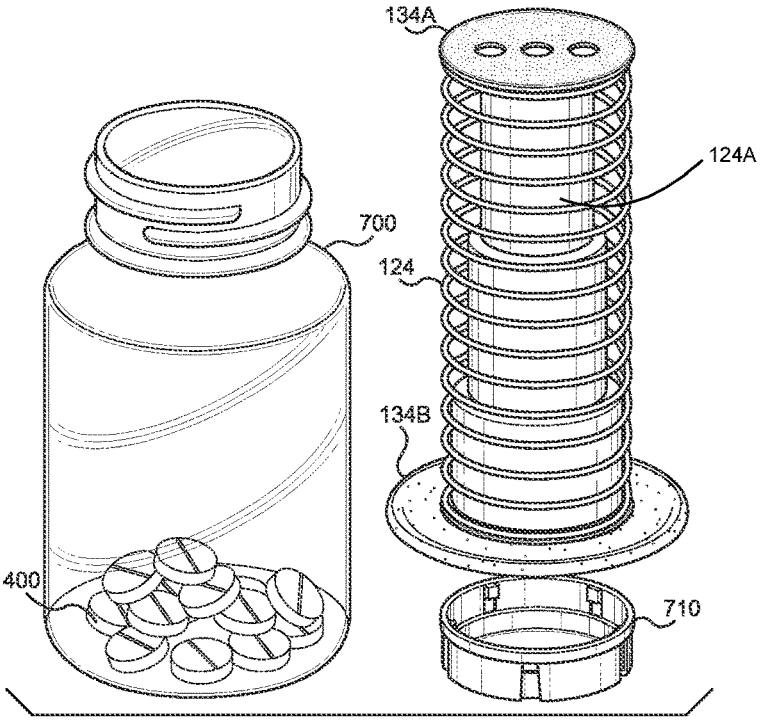
FIG. 15B illustrates a perspective view of the insert apparatus of the of FIG. 15A further shown with a telescoping piston or multi-stage cylinder member disposed within the compression spring and further showing the seals of varying sizes on both ends that are independent of the container cap, wherein the insert apparatus is shown removed from the pill container.

FIGS. 15A-15B illustrate another non-limiting exemplary embodiment of insert 800 of the disclosure described herein for using the insert with asymmetrical shaped pill containers. Specifically, in this embodiment, pill container headspace occupying insert apparatus 800 is disclosed having a plunger, end cap, seal, or discs 134A on one end and another plunger, end cap, seal, or disc 134B at another end, wherein the perimeter of discs 134A and 134B can align and abut against the inner diameter walls of the pill container body 700 in which it is to be inserted therein, therefore creating a seal with the inner wall of the pill container 700. Specifically, disc 134B is configured to be larger than disc 134A in order to accommodate pill containers having various shapes or configurations that do not conform to a traditional unitary cylindrical shape. In particular, disc 134A is shaped such that it encompasses the inner top cylindrical region of container 700, whereas disc 134B is shaped such that it encompasses the inner lower (and larger in diameter) region of container 700. Here, discs 134A and 134B can be made of any material, including but not limited to foam material, polyethylene foam, closed cell foam, plastic, metal, wood, rubber, or any polymer-based or fiber-based material. In addition, discs 134A and 134B may be round, circular, ellipsoid, square, rectangular, cylindrical, asymmetrical, or have any disc-shaped in configuration of any thickness. Here, discs 134A or 134B can be biased via a compression spring 124 and each secured to the distal ends of spring 124. It is contemplated within the scope of the present disclosure described that any other biasing member may also be used in lieu of or in addition to spring 124, such as a helical-based biasing member. Here, spring 124 can further include a telescoping piston or multi-stage cylinder member 124A disposed within spring 124, such as three ringed cylinders of varying sizes configured to collapse into each other or expand away from each other in concert with the movement of spring 124. Piston member 124A can generally assist spring 124 to move in a uniform up and down compression pattern without unnecessarily swaying to one side when inserted within the pill container, in addition to preventing overextension of spring 122. In particular, one end of piston member 124A can be secured to the seal 134A and the other end to seal 134B. Further, it is contemplated within the scope of the disclosure described herein that piston member 122A can have any number of telescoping cylinders, such as two or three or more.

Still referring to FIGS. 15A-15B spring 124 is configured to provide downward force or pressure on the pills or tablets (and upward pressure on the inner region of cap 710) being contained within pill container 700 once insert 800 and discs 134A and 134B thereof of are inserted into pill container 700 (with cap 710 secured to the open end of container 700). Once insert 800 is inserted, spring 124 can be compressed to any degree depending on the volume or amount of pills within container 700. Here, discs 134A and 134B can also maintain an appropriate diametric gap or space gap with the inner pill body wall to ensure ease of insertion and air passage to avoid a vacuum. Specifically, the diameter (or the end-to-end length) of discs 134A and 134B may be slightly less than the diameter (or the end-to-end length) of the interior wall of pill container 700. However, the gap between discs 134A and 134B and inner walls of container 700 need not be larger than the product or pills being contained. In addition, discs 134A and 134B may contain one or more holes, apertures, or perforations, or a mesh screen to allow the passage of air therethrough to avoid a vacuum.

Figure 16:
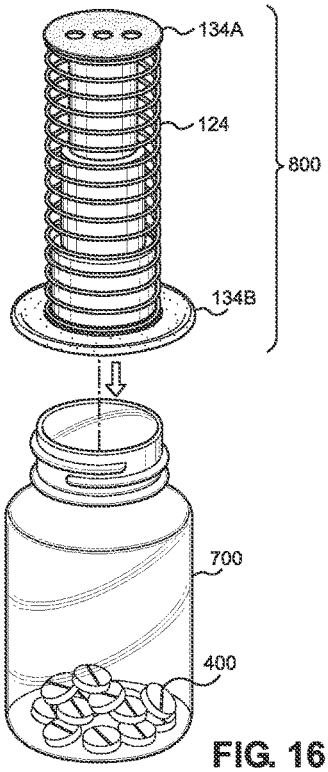
FIGS. 16-18 illustrate perspective views of the insert apparatus of FIGS. 15A-15B shown in a method of inserting the insert apparatus into the pill container.
Figure 17:
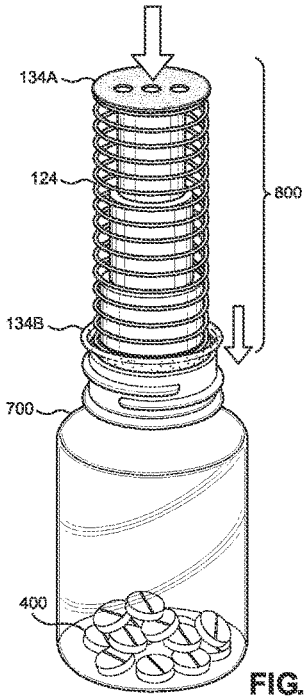
Figure 18:
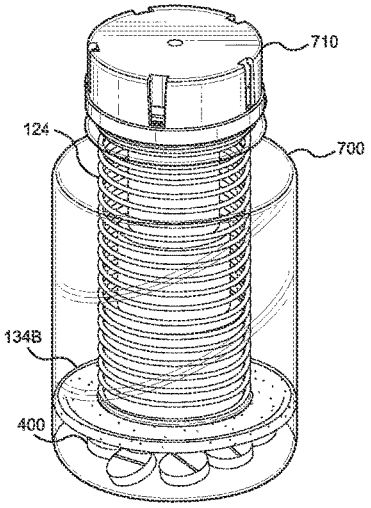

FIGS. 16-18 illustrate one method of inserting insert 800 for the embodiment of FIGS. 15A-15B into the asymmetrical pill container 700. In particular, while spring 124 is an un-compressed state or configuration, insert 800 is inserted inside of pill container 700, wherein disc 134B makes contact with and abuts against pills 400 therein. Next, closure cap 710 of the pill container can then be placed on top of disc 134A such that it abuts against it. Next, cap 710 can then be secured or locked on to the top of the pill container such that the cap exerts a downward force on top of disc 134A and spring 124, such that spring 124 is compressed into a compressed state or configuration, whereby disc 134B exerts a downward pressure on pills 400, keeping the pills secure within the pill container.

Figure 19:
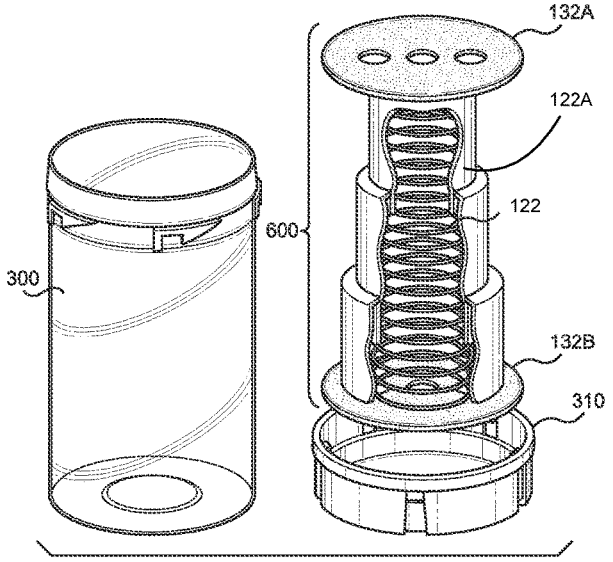
FIG. 19 illustrates a perspective view for the insert apparatus of FIGS. 12A-12B in another non-limiting exemplary embodiment of the disclosure described herein, shown in a partial cut-away view with the compression spring member disposed within the telescoping piston or multi-stage cylinder member.

FIG. 19 illustrates another non-limiting exemplary embodiment for the insert apparatus 600 of FIGS. 12A-12B, shown with compression spring member 122 disposed within the telescoping piston or multi-stage cylinder member 122A.

Figure 20:
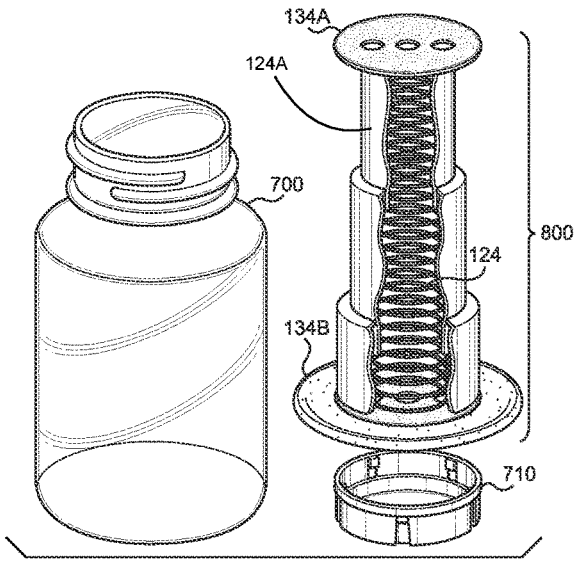
FIG. 20 illustrates a perspective view for the insert apparatus of FIGS. 15A-15B in another non-limiting exemplary embodiment of the disclosure described herein, shown in a partial cut-away view with the compression spring member disposed within the telescoping piston or multi-stage cylinder member.

FIG. 20 illustrates another non-limiting exemplary embodiment for the insert apparatus 800 of FIGS. 15A-15B, shown with compression spring member 124 disposed within the telescoping piston or multi-stage cylinder member 124A.

It is contemplated within the scope of the present disclosure described herein that insert 100, 600, and 800 may be used with any type of pill container for any type of pills, including but not limited to, prescription medication or any health, nutritional, or dietary supplement having any shape or configuration.

Having thus described the several embodiments of the present disclosure described herein, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention. Although the present disclosure described herein has been described in considerable detail with reference to certain preferred versions or embodiments thereof, other versions and embodiments are possible. Therefore, the spirit and scope of the appended claims should not be limited to the description of the embodiments contained herein.

What is claimed is:

1. An insert and pill container system, comprising:

the insert having a biasing member comprising: a first end and a second end, wherein the biasing member is comprised of a compression spring;

a telescoping cylinder member disposed within the compression spring;

a first disc secured to the first end of the biasing member and a second disc secured to the second end of the biasing member; and wherein the first disc or second disc is configured to substantially align with an interior space of the pill container.

2. The insert and pill container system of claim 1, wherein the first and second discs are comprised of one or more of: foam material, polyethylene foam, closed cell foam, rubber, and any polymer-based material.

3. The insert and pill container system of claim 1, wherein a diameter of the second disc is larger than a diameter of the first disc.

4. The insert and pill container system of claim 1, wherein a diameter of the first and second discs are greater than an inner diameter of the pill container.

5. The insert and pill container system of claim 1, wherein a diameter of the first and second discs are less than an inner diameter of the pill container.

6. The insert and pill container system of claim 1, wherein a diameter of the first or second discs are substantially the same as an inner diameter of the pill container.

7. The insert and pill container system of claim 1, wherein a height of the insert is higher than a height the pill container.

8. The insert and pill container system of claim 1, wherein the first or second discs further comprise one or more holes, apertures, or openings.

* * * * *